US006229121B1

(12) United States Patent
Jang et al.

(10) Patent No.: US 6,229,121 B1
(45) Date of Patent: May 8, 2001

(54) INTEGRATED THERMAL BUCKLING MICRO SWITCH WITH ELECTRIC HEATER AND SENSOR

(75) Inventors: Ruei-Hung Jang, Hsin-Chuang; Ming-Jye Tsai, Hsin-Chu; Lieh-Hsi Lo, Hsin-Chu Hsien, all of (TW)

(73) Assignee: Industrial Technology Research Institute, Hsinchu Hsien (TW)

( * ) Notice: Subject to any disclaimer, the term of this patent is extended or adjusted under 35 U.S.C. 154(b) by 0 days.

(21) Appl. No.: 09/359,420

(22) Filed: Jul. 23, 1999

(51) Int. Cl.[7] ..... H01H 37/00

(52) U.S. Cl. ..... 219/505; 219/511; 337/107; 337/298

(58) Field of Search ..... 219/505, 511, 219/510; 73/204.26, 204.17, 204.16; 337/102, 107, 298; 338/307–309, 22 R

(56) References Cited

U.S. PATENT DOCUMENTS 4,174,511 * 11/1979 Knapp et al. ..... 337/102
4,423,401 * 12/1983 Mueller ..... 337/107
5,721,525 * 2/1998 Hofsass ..... 337/102
5,770,993 * 6/1998 Miyazawa et al. ..... 337/160
5,804,798 * 9/1998 Takeda ..... 337/107
5,892,429 * 4/1999 Hofsass ..... 337/377

FOREIGN PATENT DOCUMENTS

3231136 * 2/1984 (DE) .
2-226627 * 9/1990 (JP) .

* cited by examiner

*Primary Examiner*—John A. Jeffery
(74) *Attorney, Agent, or Firm*—Bacon & Thomas

(57) ABSTRACT

An integrated thermal buckling micro switch is made by using electromechanical technology to integrate sensors and actuators on a single chip. An epitaxial chip is used and etched to form a mesa structure on a thin silicon film, whereon at least a thermal sensing element and a heating element are disposed. When an output signal of the thermal sensing element is greater than a pre-set critical value in a control circuit, the heating element is driven to heat, so that the thin silicon film will create a thermal buckling effect that makes the mesa structure touch at least one contact point on the baseboard to cut off or effectuate the circuit. On the contrary, when heating is ceased, the mesa structure will return back to the original normal state, and thereby, switching and controlling an external load can be achieved.

8 Claims, 5 Drawing Sheets

INTEGRATED THERMAL BUCKLING MICRO SWITCH WITH ELECTRIC HEATER AND SENSOR

BACKGROUND OF THE INVENTION

This invention relates to an integrated thermal buckling micro switch, particularly to the integrated thermal buckling micro switch wherein the sensors and actuators are integrated and arranged on a single chip by using micro electromechanical technology.

A conventional thermal buckling switch is usually constructed in a mechanical bimetal structure, wherein two kinds of metal with different thermal expansion coefficients are combined. When the switch is heated to some extent, two contact points of the bi-metal structure will depart from or embrace each other to cut off or drive a circuit.

The thermal buckling switch of mechanical bimetal structure can hardly be pre-set to act at a precise temperature, it is supposed to buckle within a temperature range instead, hence, it only fits systems that require rough temperature control.

In addition, elastic fatigue of a bimetal may come out after repeated expansion and shrinkage to blunt its sensitivity.

Furthermore, the thermal buckling switch of mechanical bimetal structure usually requires extra cooperative mechanical parts that may slow down response of the switch, and besides, its bulky volume and high cost will inevitably reduce its competition capability in the market, and the worst part is that it can hardly be

SUMMARY OF THE INVENTION

This invention is proposed to integrate and dispose the sensors and actuators on a single chip.

Another object of this invention is to provide an integrated thermal buckling micro switch serving as a signal transmission control system with active sensing capability for different operation modes, such as normally open, normally closed or combined according to requirements, wherein critical conditions may be pre-set for switching, and plural actuators can be integrated on a single chip in a matrix array for use in parallel or series connection.

A further object of this invention is to provide an integrated thermal buckling micro switch that can serve as a protector against system overheat.

A furthermore object of this invention is to provide an integrated thermal buckling micro switch with merits of small volume, quick response, least assembly, and easiness for being integrated to ICs.

In order to achieve above objects, an epitaxial chip is etched to form a thin silicon film having a mesa structure, then a thermally sensitive element and a heating element are disposed on the film sequentially. When resistance of the thermally sensitive element becomes greater to produce a signal larger than a pre-set value, the heating element is started to heat that would causes a thermal buckling effect of the thin silicon film, so that a metallic layer of the mesa structure moves to touch the contact points on a baseboard. When the heating element controlled by a control circuit cease to heat, the mesa structure returns back to normal state to thus control switching of an external load.

BRIEF DESCRIPTION OF THE DRAWINGS

For a better understanding to the present invention, together with further advantages or features thereof, at least one preferred embodiment will be elucidated below with reference to the annexed drawings in which.

DETAILED DESCRIPTION OF THE PREFERRED EMBODIMENT

Figure 1:
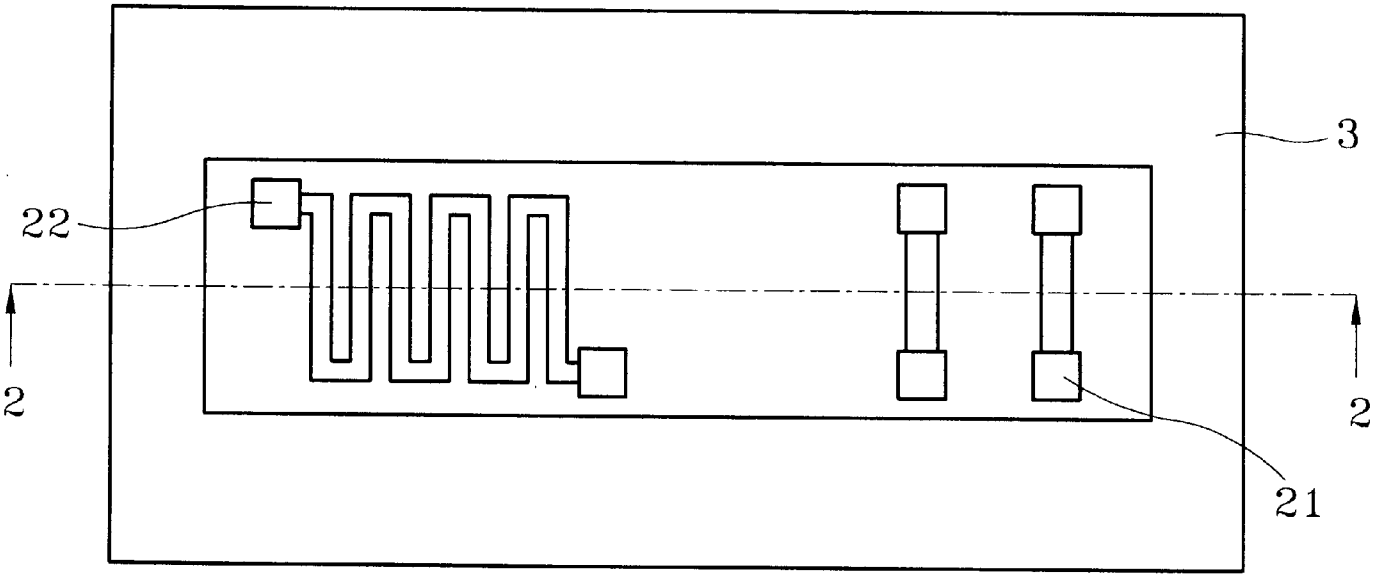
FIG. 1 is a structural schematic top view of an integrated thermal buckling micro switch of this invention.
Figure 2:
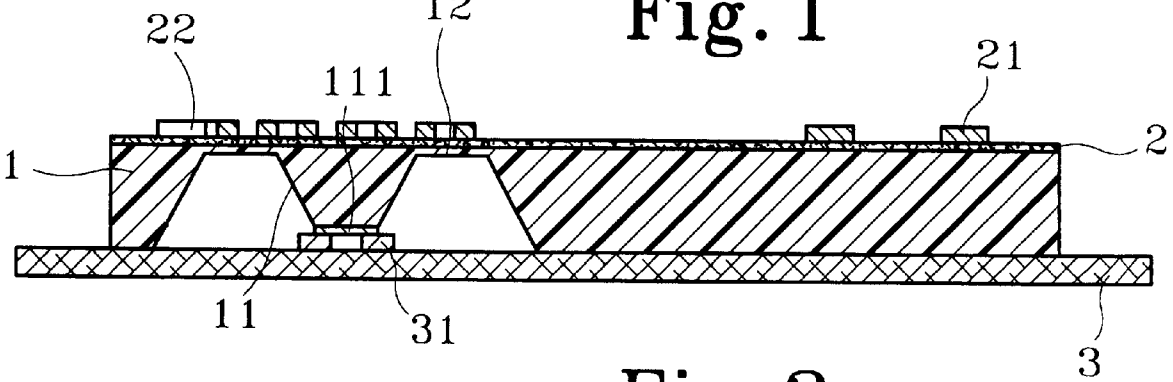
FIG. 2 is a structural schematic lateral view of the integrated thermal buckling micro switch of this invention.

As shown in FIGS. 1 and 2 a structural schematic top view and lateral view of an integrated thermal buckling micro switch of this invention, a sensor and an actuator are integrated and laid on a chip, so that when change of the ambient temperature is greater than a pre-set value, a processed and amplified output signal from a control circuit will be applied to the actuator for action mode selection.

The sensor is formed by depositing at least a thermally sensitive element 21 on a thin silicon film 1, wherein the thermally sensitive element 21 can be, but not necessarily be, a platinum resistor or a thermistor to serve for a sensor; one end of the thin silicon film 1 is back-etched to form at least a mesa structure 11 and a reaction portion 12 at each wing respectively. Further, one end of the mesa structure 11 is deposited to form a metallic layer 111, and a heating element 22 on an epitaxial layer 2 above the mesa structure 11 can be, but not necessarily be, a platinum resistor. The primarily completed thin silicon film 1 is adhered on a baseboard 3, which can be, but not necessarily be, made in ceramics or materials used for PCB. Two contact points 31 are formed on the baseboard 3 at positions corresponding to the metallic layer 111 of the mesa structure 11 for contacting with a printed circuit, and thereby to form an actuator. The thermal sensitive element 21 and the heating element 22 are then connected to the baseboard 3 via a transmission line 5 to construct an integrated thermal buckling micro switch.

Figure 3:
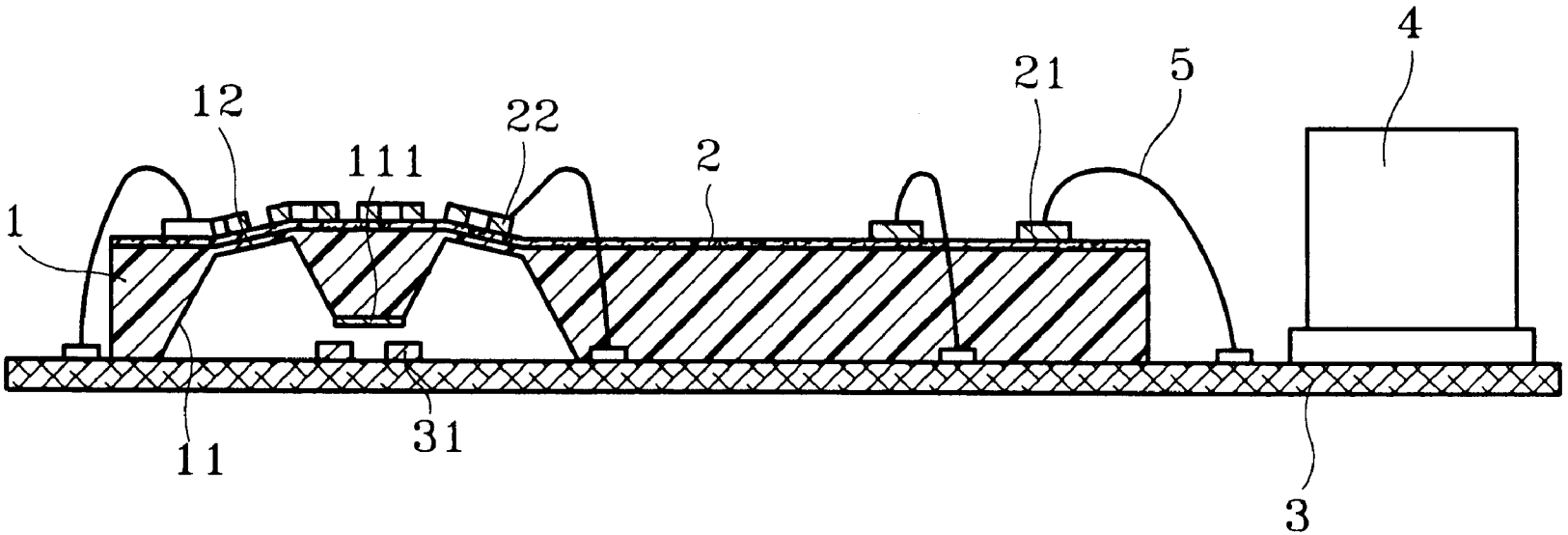
FIG. 3 is a schematic view showing an application example of this invention in heating state.

As shown in FIG. 3 an application example of this invention in heating state, a control circuit 4 may be built on the baseboard 3 or established externally for connection with the integrated thermal buckling micro switch, wherein a critical resistance is pre-set in the control circuit 4 for switching purpose.

The resistance in the thermal sensitive element 21 is changeable in wake of change of the ambient temperature. For example, when the control circuit 4 receives a signal from the thermally sensitive element 21 via the printed circuit on the baseboard 3 greater than that of the pre-set value in the control circuit 4, the heating element 22 on the epitaxial layer 2 will be driven to start heating. The reaction portions 12 of the thin silicon film 1 will produce a thermal buckling effect to detach the metallic layer 111 of the mesa structure 11 from the contact points 31 on the baseboard 3 to cut off the circuit; and on the contrary, when the heating element 22 is uneffectuated, the metallic layer 111 of the mesa structure 11 returns back to the normal state, and by the above, an external load is controlled.

Figure 6:
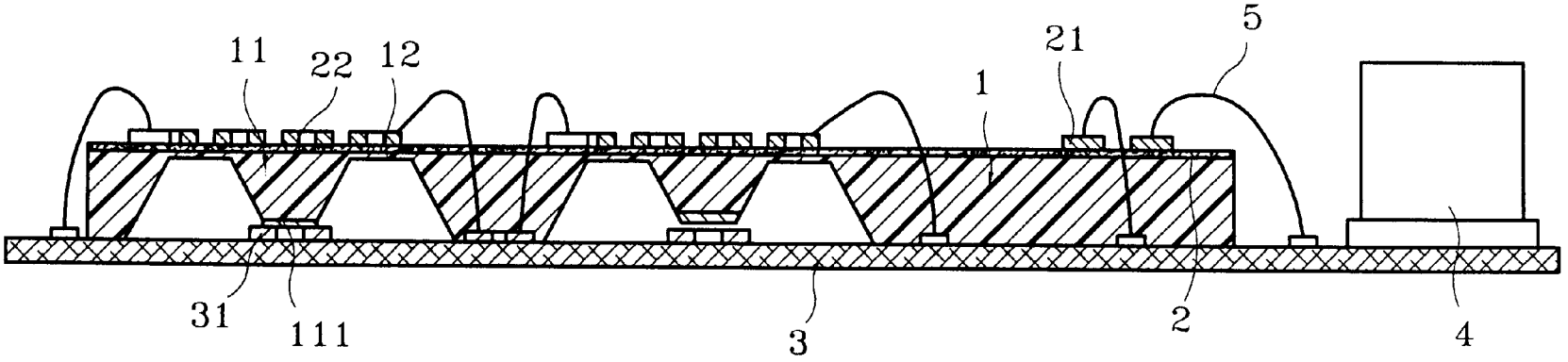
FIG. 6 shows a 2nd embodiment of this invention.
Figure 7:
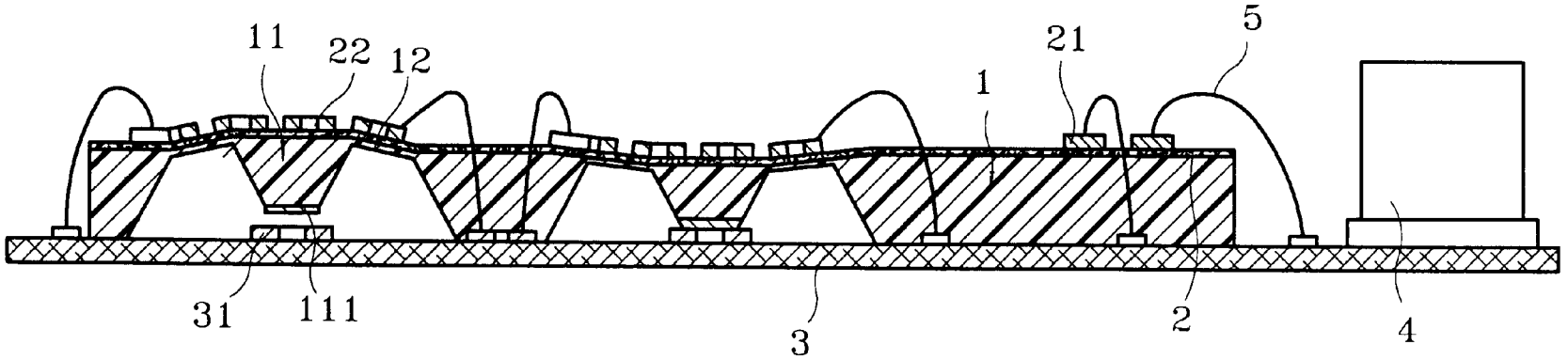
FIG. 7 shows FIG. 6 in heating state.
Figure 8:
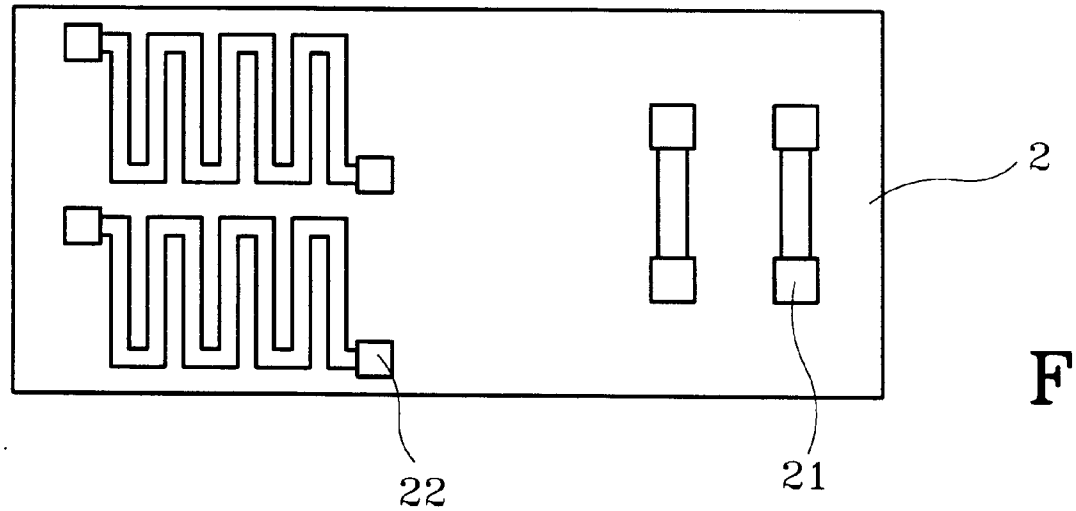
FIG. 8 shows a 3rd embodiment of this invention.
Figure 9:
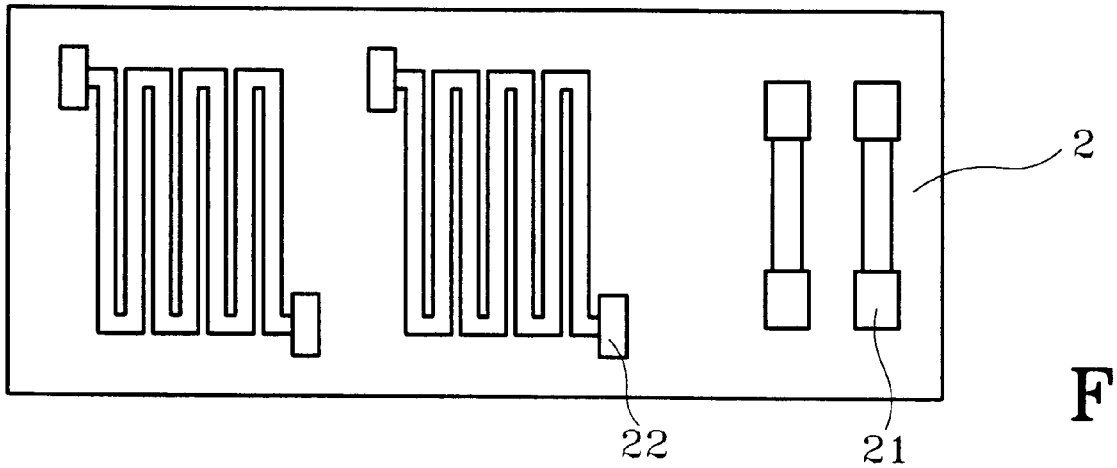
FIG. 9 shows a 4th embodiment of this invention.

As shown in FIGS. 6 and 7 a 2nd embodiment of this invention and its heating state, the integrated thermal buckling micro switch may have a normally open and a normally closed buckling switches concurrently to be heated in the foregoing manner for controlling switching of different loads.

Figure 4:
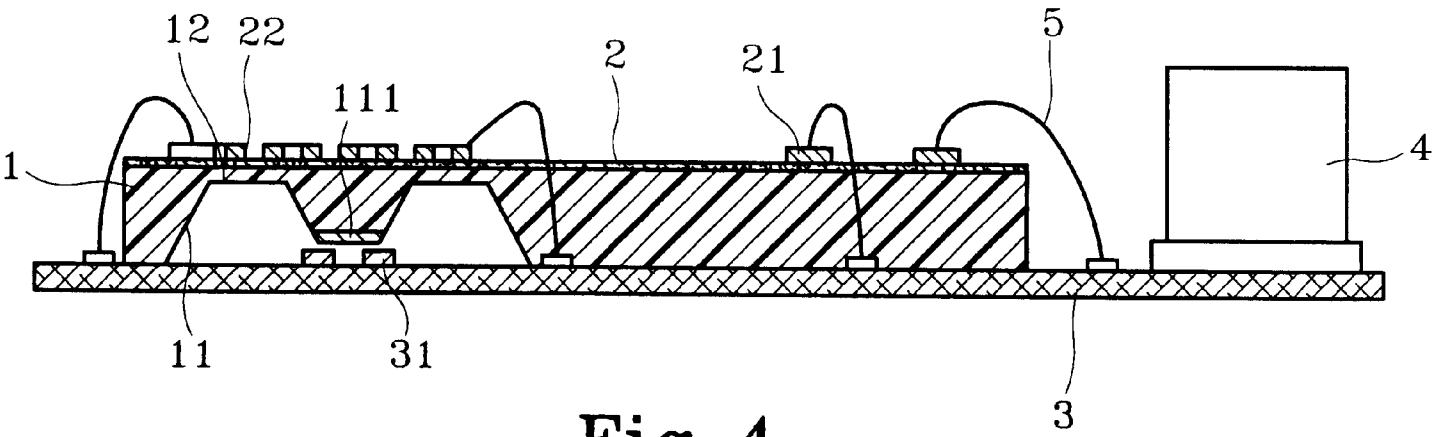
FIG. 4 shows a 1st embodiment of this invention.
Figure 5:
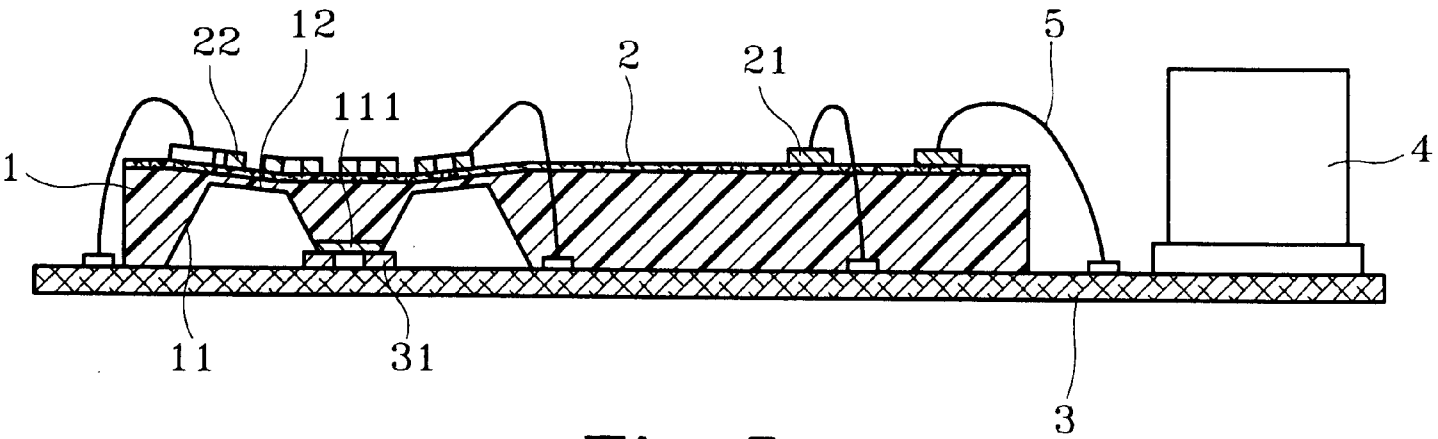
FIG. 5 shows FIG. 4 in heating state.

FIG. 3 and FIG. 4 represent a 3rd and a 4th embodiment of this invention, wherein a plurality of buckling switches may be arranged in an matrix for use in parallel and series connections.

It is noted from the above that the integrated thermal buckling micro switch is a signal transmission and control system with active sensing capability, wherein normally open, normally close, or combined operation modes may be selected according to different applications; critical conditions may be pre-set for switching; and plural buckling micro switches may be integrated in a matrix array on a single chip for use in parallel or series connection. The integrated thermal buckling micro switch may serve as an overheat protector for various systems with merits of small size, quick response, and easy integration with ICs.

Although, this invention has been described in terms of preferred embodiments, it is apparent that numerous variations and modifications may be made without departing from the true spirit and scope thereof, as set forth in the following claims.

What is claimed is:

1. An integrated thermal buckling micro switch, comprising:

a baseboard with printed circuit having at least a contact point;

a thin silicon film disposed on said baseboard having a mesa structure which is deposited at one end to form a metallic layer for contacting with said contact point;

an epitaxial layer formed on said thin silicon film; and at least a thermal sensitive element and a heating element disposed on said epitaxial layer;

the integrated thermal buckling micro switch having at least a sensor and a actuator, wherein resistance of the sensor is changeable according to ambient temperature; an output signal of the sensor is processed in an externally connected control circuit for decision if heating of the actuator is required for switching purposes.

2. The integrated thermal buckling micro switch of claim 1, wherein said baseboard is made of ceramics.

3. The integrated thermal buckling micro switch of claim 1, wherein said thermal sensitive element is a platinum resistor or a thermistor.

4. The integrated thermal buckling micro switch of claim 1, wherein said heating element is a platinum resistor.

5. The integrated thermal buckling micro switch of claim 1, wherein said actuator is made in form of a single normally open or normally closed integrated thermal buckling micro switch.

6. The integrated thermal buckling micro switch of claim 1, wherein said actuator is made by combining a plurality of normally open or normally closed integrated thermal buckling micro switches.

7. The integrated thermal buckling micro switch of claim 1, wherein a plurality of said actuators may be integrated on a single chip in a matrix array for use in a parallel or series connection.

8. The integrated thermal buckling micro switch of claim 1, wherein said control circuit may be made on said baseboard directly.

* * * * *